US008919066B2

(12) United States Patent
Ovaert

(10) Patent No.: US 8,919,066 B2
(45) **Date of Patent: *Dec. 30, 2014**

(54) FLOORING APPARATUS FOR REDUCING IMPACT ENERGY DURING A FALL

(75) Inventor: Timothy C. Ovaert, Notre Dame, IN (US)

(73) Assignee: University of Notre Dame du Lac, Notre Dame, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/342,605

(22) Filed: Jan. 3, 2012

(65) Prior Publication Data

US 2013/0000228 A1 Jan. 3, 2013

Related U.S. Application Data

(63) Continuation-in-part of application No. 11/673,398, filed on Feb. 9, 2007, now Pat. No. 8,109,050.

(60) Provisional application No. 60/771,630, filed on Feb. 9, 2006, provisional application No. 60/793,457, filed on Apr. 20, 2006.

(51) Int. Cl.

| | |
|---|---|
| ***E04H 9/00*** | (2006.01) |
| ***E04F 11/16*** | (2006.01) |
| ***E04F 15/00*** | (2006.01) |
| ***E04F 15/22*** | (2006.01) |
| *A62B 1/22* | (2006.01) |

(52) U.S. Cl.

CPC .. *E04F 15/22* (2013.01); *A62B 1/22* (2013.01)
USPC ..... 52/403.1; 52/1; 52/177; 52/181

(58) Field of Classification Search

USPC ..... 52/1, 177, 181, 403.1, 573.1
See application file for complete search history.

(56) References Cited

U.S. PATENT DOCUMENTS

| | | | |
|---|---|---|---|
| 1,693,655 | A | 12/1928 | Murphy |
| 2,653,525 | A | 9/1953 | McGuire |
| 3,251,076 | A | 5/1966 | Burke |
| 3,305,227 | A | 2/1967 | Henley |
| 3,438,312 | A | 4/1969 | Becker et al. |
| 3,636,577 | A | 1/1972 | Nissen |

(Continued)

FOREIGN PATENT DOCUMENTS

| | | |
|---|---|---|
| JP | 1980000034720 | 10/1981 |
| JP | 1980000034721 | 10/1981 |

OTHER PUBLICATIONS

International Search Report Corresponding to International Application No. PCT/US07/61933, Mailed Jun. 5, 2008, 2 pgs.

(Continued)

*Primary Examiner* — Ryan Kwiecinski
(74) *Attorney, Agent, or Firm* — Greenberg Traurig, LLP

(57) ABSTRACT

An apparatus including an impact surface and a plurality of spaced apart stiffening columns extending from an underside of the flooring plate. The columns remain substantially rigid up to a predetermined critical pressure and then buckle as the pressure increases. The columns are at least partially surrounded by a resilient underlayment. Deflection stops may extend from the flooring plate to prevent over-buckling and/or permanent deformation of the stiffening columns. In some examples, the deflections stops may assist the floor in providing a substantially rigid surface at very high pressures.

19 Claims, 7 Drawing Sheets

(56) References Cited

U.S. PATENT DOCUMENTS

| | | | | | |
|---|---|---|---|---|---|
| 3,732,138 | A | * | 5/1973 | Almog | 428/114 |
| 3,808,628 | A | | 5/1974 | Betts | |
| 3,948,500 | A | | 4/1976 | Korbuly et al. | |
| 4,054,987 | A | | 10/1977 | Forlenza | |
| 4,277,055 | A | | 7/1981 | Yamaguchi et al. | |
| 4,557,475 | A | | 12/1985 | Donovan | |
| 4,604,509 | A | | 8/1986 | Clancy et al. | |
| 4,727,697 | A | | 3/1988 | Vaux | |
| 4,805,886 | A | | 2/1989 | Hassan | |
| 4,807,412 | A | | 2/1989 | Frederiksen | |
| 4,846,457 | A | | 7/1989 | Vaux | |
| 4,848,058 | A | | 7/1989 | Mullen | |
| 4,860,516 | A | | 8/1989 | Koller | |
| 4,921,741 | A | | 5/1990 | Mullen | |
| 4,948,116 | A | | 8/1990 | Vaux | |
| 4,991,834 | A | | 2/1991 | Vaux | |
| 4,998,717 | A | | 3/1991 | Vaux | |
| 5,228,253 | A | | 7/1993 | Wattelez | |
| 5,234,738 | A | * | 8/1993 | Wolf | 428/120 |
| 5,251,742 | A | | 10/1993 | Campbell | |
| 5,368,154 | A | | 11/1994 | Campbell | |
| 5,509,244 | A | | 4/1996 | Bentzon | |
| 5,542,221 | A | * | 8/1996 | Streit et al. | 52/403.1 |
| 5,566,930 | A | | 10/1996 | Niese | |
| 5,713,175 | A | | 2/1998 | Mitchell | |
| 5,744,763 | A | | 4/1998 | Iwasa et al. | |
| 5,749,111 | A | | 5/1998 | Pearce | |
| 5,761,867 | A | * | 6/1998 | Carling | 52/386 |
| 5,778,621 | A | | 7/1998 | Randjelovic | |
| 5,806,270 | A | | 9/1998 | Solano et al. | |
| 5,976,451 | A | | 11/1999 | Skaja et al. | |
| 5,992,105 | A | | 11/1999 | Kessler et al. | |
| 6,026,527 | A | | 2/2000 | Pearce | |
| 6,029,962 | A | | 2/2000 | Shorten et al. | |
| 6,044,606 | A | | 4/2000 | Hamar | |
| 6,115,981 | A | | 9/2000 | Counihan | |
| 6,127,015 | A | | 10/2000 | Kessler | |
| 6,164,031 | A | | 12/2000 | Counihan | |
| 6,296,669 | B1 | | 10/2001 | Thorn et al. | |
| 6,394,432 | B1 | | 5/2002 | Whiteford | |
| 6,405,495 | B1 | | 6/2002 | Kessler et al. | |
| 6,457,261 | B1 | | 10/2002 | Crary | |
| 6,487,796 | B1 | | 12/2002 | Avar et al. | |
| 6,531,203 | B2 | | 3/2003 | Kessler | |
| 6,878,430 | B2 | | 4/2005 | Milewski | |
| 7,211,314 | B2 | | 5/2007 | Nevison | |
| 7,462,253 | B2 | | 12/2008 | Nevison | |
| 7,571,572 | B2 | | 8/2009 | Moller, Jr. | |
| 7,575,795 | B2 | | 8/2009 | Scott | |
| 7,748,177 | B2 | | 7/2010 | Jenkins et al. | |
| 8,109,050 | B2 | * | 2/2012 | Ovaert | 52/181 |
| 8,241,726 | B2 | * | 8/2012 | Scott et al. | 428/120 |
| 2001/0007236 | A1 | | 7/2001 | Tajima et al. | |
| 2003/0186025 | A1 | * | 10/2003 | Scott et al. | 428/119 |
| 2005/0193669 | A1 | | 9/2005 | Jenkins | |
| 2005/0214498 | A1 | | 9/2005 | Nevison | |
| 2005/0281999 | A1 | | 12/2005 | Hofmann et al. | |
| 2007/0056237 | A1 | | 3/2007 | Kang et al. | |
| 2007/0087154 | A1 | | 4/2007 | Bird et al. | |
| 2007/0204545 | A1 | | 9/2007 | Ovaert | |
| 2008/0213529 | A1 | | 9/2008 | Gray et al. | |
| 2010/0024329 | A1 | * | 2/2010 | Gray et al. | 52/220.1 |
| 2011/0072748 | A1 | | 3/2011 | Simonson et al. | |

OTHER PUBLICATIONS

Written Opinion of the International Search Authority Corresponding to International Application No. PCT/US07/61933, Mailed Jun. 5, 2008, 5 pgs.

"Accident Facts," National Safety Counsel, 1990 Edition, 9 pgs., Chicago.

Philips et al., "Aging and Public Health," 1985, 23 pgs., Springer Publishing Company, Inc., New York.

DeVito et al., "Fall Injuries Among the Elderly," Journal of the American Geriatrics Society, vol. 36, 1988, 8 pgs.

Tidelksaar, Rein, "Falls in the Elderly: A literature Review," Age, vol. 11, Issue 3, Jul. 1988, 4 pgs.

Grisso et al., "Injuries in an Elderly Inner-City Population," The American Geriatrics Society, 1990, 7 pgs.

"Healthy People 2000," National Health Promotion and Disease Prevention Objectives, U.S. Department of Health and Human Services Public Health Service, 1992, 6 pgs., Jones and Bartlett Publishers, Inc., Boston.

"Injury Prevention: Meeting the Challenge," The National Committee for Injury Prevention and Control, American Journal of Preventive Medicine, vol. 5, No. 3, 1989, 4 pgs.

Older Americans 2004: Key Indicators of Well-Being, Federal Interagency Forum on Aging-Related Statistics. Nov. 2004, 160 pages, U.S. Government Printing Office, Washington, D.C.

Sattin et al., "The Incidence of Fall Injury Events Among the Elderly in a Defined Population." American Journal of Epidemiology, vol. 131, No. 6, 1990, 5 pgs., The John Hopkins University School of Hygiene and Public Health.

Sorock, Gary S., "Falls Among the Elderly: Epidemiology and Prevention," American Journal of Preventive Medicine, vol. 4, No. 5, 1988, 8 pgs.

United States Population Estimates, by Age, Sex, and Race: 1980-1987, U.S. Department of Commerce, Mar. 1988, 13 pgs.

Waller, Julian A., "Falls Among the Elderly—Human and Environmental Factors," Accident Analysis and Prevention, vol. 10, 1978, 13 pgs.

International Search Report and Written Opinion of PCT/US13/20148, mailed on Apr. 26, 2013, 8 pgs.

* cited by examiner

FLOORING APPARATUS FOR REDUCING IMPACT ENERGY DURING A FALL

CROSS REFERENCE TO RELATED APPLICATION

This application is a continuation-in-part of U.S. patent application Ser. No. 11/673,398 entitled "Flooring Apparatus For Reducing Impact Energy During A Fall," filed Feb. 9, 2007, now U.S. Pat. No. 8,109,050, which is a non-provisional application claiming priority from U.S. Provisional Application Ser. No. 60/771,630, filed Feb. 9, 2006, entitled "SorbaShock Pressure Reduction Flooring" and from U.S. Provisional Application Ser. No. 60/793,457, filed Apr. 20, 2006, each of which is incorporated herein by reference in their entirety.

FIELD OF THE DISCLOSURE

The present disclosure relates generally to cushioned flooring systems, and in particular to a flooring apparatus for reducing impact energy during a fall.

BACKGROUND OF RELATED ART

It is known that falls represent a leading cause of non-fatal injuries in the United States (Cost of Injury, 1989). In 1985, for example, falls accounted for an estimated 21% of non-hospitalized injured persons (11.5 million people) and 33% of hospitalized injured persons (783,000 hospitalizations). In addition 9% of fatalities (12,866 deaths) were related to falls. Some estimates have said that the cost of fall related injuries in the United States in 2000 was approximately $20 billion dollars.

A number of epidemiological studies report a drastic increase of fall incidence rate in the population over the age of 65, suggesting a direct relationship between aging and the frequency of kill events (Sorock, 1988; Healthy People 2000, 1990; Injury Prevention: Meeting the Challenge, 1989; National Safety Council. 1990: Grisso et al., 1990; DeVito et al., 1988: Waller, 1985; Waller. 1985: Sattin et at., 1990). Although the exact incidence of non-fatal falls is difficult to determine, it has been estimated that approximately 30% of all individuals over the age of 65 have at least one fall per year (Sorock, 1988).

When the dramatic growth in the number of people over 65 and their proportion in the population is considered, this represents a significant health problem. By some estimates, this age group currently makes up 12.4% of the U.S. population, with a projected increase to 19.6% by the year 2030 (Federal Interagency Forum on Aging-Related Statistics, 2004). Of particular note is the growth of the "oldest old" (i.e. those people over 75). In the decade between 1990 and 2000, the greatest growth in the over 55 age group was projected to be among those 75 and older—an increase of 26.2 percent or a gain of nearly 4.5 million (U.S. Dept. of Commerce, Bureau of Census, 1988).

In Injury in America (1985, p. 43) the authors stated that "Almost no current research deals with the mechanisms and prevention of injury from falls (the leading cause of non-fatal injury) . . . . Little is known about the effectiveness of energy-absorbing materials, either worn by persons at high risk or incorporated in the surfaces onto which they fall."

Typically, current approaches to solving the problem of injury from falls include devices which use composite matting to absorb energy resulting from patient/floor impact during falls. For example, U.S. Pat. Nos. 3,636,577, 4,557,475, 4,727,697, 4,846,457, 4,948,116, 4,991,834 and 4,998,717, each describe impact absorbing coverings which utilize air-filled cells or compressible materials to absorb the energy of a fall. Because each of these systems is always compliant (i.e., always deformable under compressive pressures), shoes, feet, and/or other contacts with the flooring surface results in relatively large mat deflections. This has the potential to increase the likelihood of falls due to toe/mat interference during foot swing, and/or presents a problem when an individual attempts to move an object over the floor (e.g., a wheelchair). These factors can be of even greater concern in a health care setting, where many residents may have an unsteady gait and/or utilize wheel chairs for locomotion.

The disclosed floor overcomes at least some of the above-described disadvantages inherent with various apparatuses and methods of the prior art. The example floor includes a flooring system which requires no special clothing or restriction of movement because the floor will act as the injury prevention system. The design incorporates a stiffened floor which remains substantially rigid under normal conditions and deflects under impact (i.e., a pressure greater than a predetermined critical pressure) to absorb the energy of the impact. Accordingly, the example floor offers a novel and effective system to reduce injuries from falls.

DETAILED DESCRIPTION

An impact-absorbing flooring system is described; with applications in various areas where there is a risk of injury due to fall and/or high-impact. For instance, the flooring system may be utilized in healthcare facilities, in sports facilities, and/or in any other commercial or residential environment. The floor may be manufactured as a single continuous floor, or may be manufactured as a modular tile that may be combined with adjoining tiles to form a floor surface. The flooring system may also take the form of a safety mat or coating for use around slippery areas, such as, for example, bathtubs, showers, swimming pools, etc.

Figure 1:
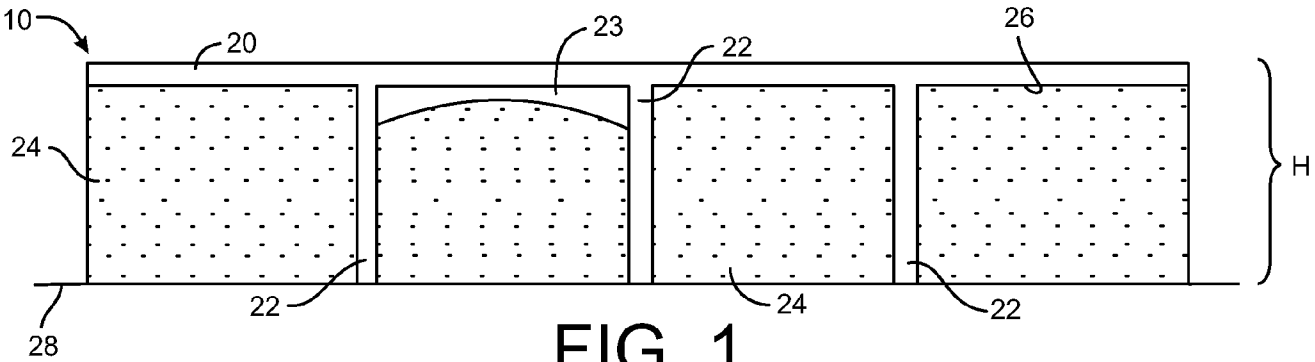
FIG. 1 is a side elevational view of an example flooring apparatus for reducing impact during a fall.
Figure 2:
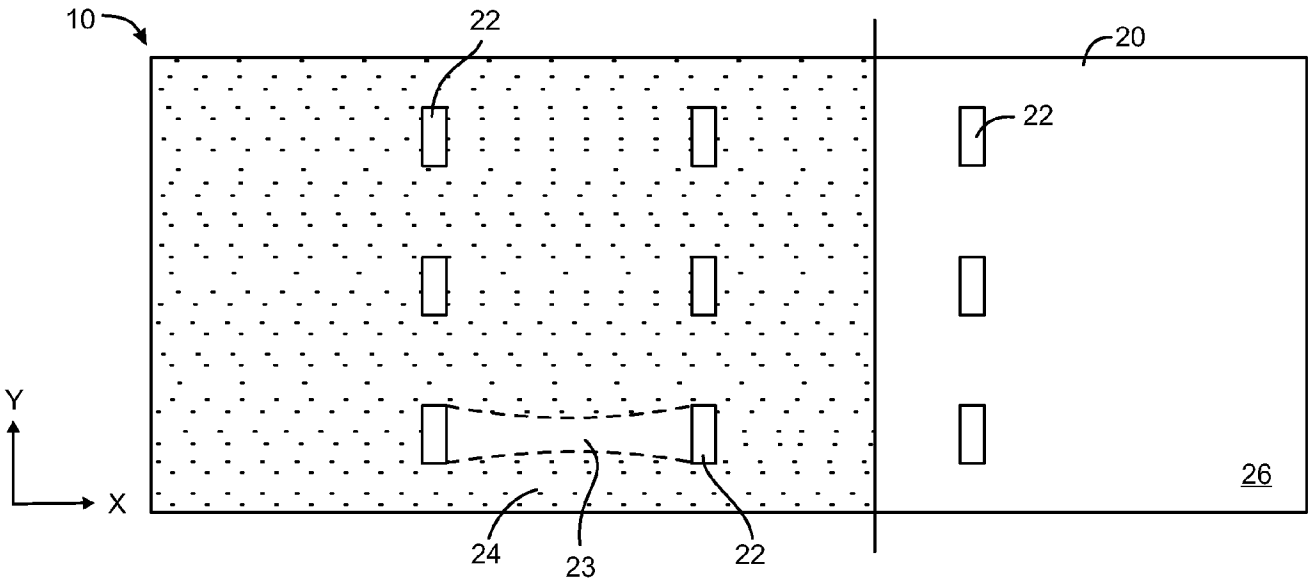
FIG. 2 is a bottom side view of the flooring apparatus of FIG. 1 with a portion of the underlayment removed.

FIGS. 1 and 2 together illustrate an example flooring apparatus 10. The apparatus 10 may provide a significant reduction in peak impact pressure during falls, yet retains a substantially non-compliant configuration during normal pressures. In particular, in the illustrated example, the apparatus 10 includes a flooring plate 20 having a plurality of spaced apart stiffening columns 22, extending from an undersurface 26 of the flooring plate 20. Each of the columns 22 may be integrally formed with the plate 20, or may be coupled to the plate 20 as desired. In the illustrated example, the stiffening columns 22 are generally rectangular and extend generally perpendicular to the plate 20. In this example, the columns are spaced at generally 90° to one another. It will be appreciated, however, that the angle from which the columns 22 extend from the plate 20, as well as the pattern of the columns 22 may be varied as desired. Furthermore, while the columns 22 are illustrated as separate bodies, the columns could be coupled via bridge-like connections, or otherwise connected together to form a straight and/or curvilinear rib 23 (see, for example, FIGS. 1, 2).

The stiffening columns 22 are at least partially (and possibly completely) surrounded by a resilient underlayment 24. The underlayment 24 may cover at least a portion of the undersurface 26 of the flooring plate 20 and may be secured thereto. Additionally, the underlayment may be secured to at least one of the columns 22. The columns 22 and/or the underlayment 24 (together or separately) are adapted to support the flooring plate 20 at a normal height H above a support surface 28, such as for example, a sub-floor.

The flooring plate 20 may be constructed Of any suitable material including, for example, wood, metal, thermoplastic, such as polyester, polypropylene, and/or polyethylene, and/or any other suitable material. Similarly, the plate 20 may be formed by any suitable manufacturing process, including, for instance, molding, stamping, rolling, etc. Additionally, while in this example the stiffening columns 22 are integrally formed with the plate 20, it will be appreciated by one of ordinary skill in the art that the columns 22 may be constructed of any appropriate material and as noted above, may be attached to the undersurface 26 via any suitable method, such as, for example, adhesive, mechanical, and/or other comparable fasteners.

In the illustrated example, the resilient underlayment 24 is a foam material, such as, for example, a polymer foam. However, it will be appreciated by one of ordinary skill in the art that the resilient underlayment 24 may be formed from any suitably resilient material, and/or composite material. Furthermore, the resilient underlayment 24 may also be secured to the undersurface 26 of the flooring plate 20 and/or the columns 22 by adhesion, mechanical connection, and/or any other appropriate method.

Figure 3:
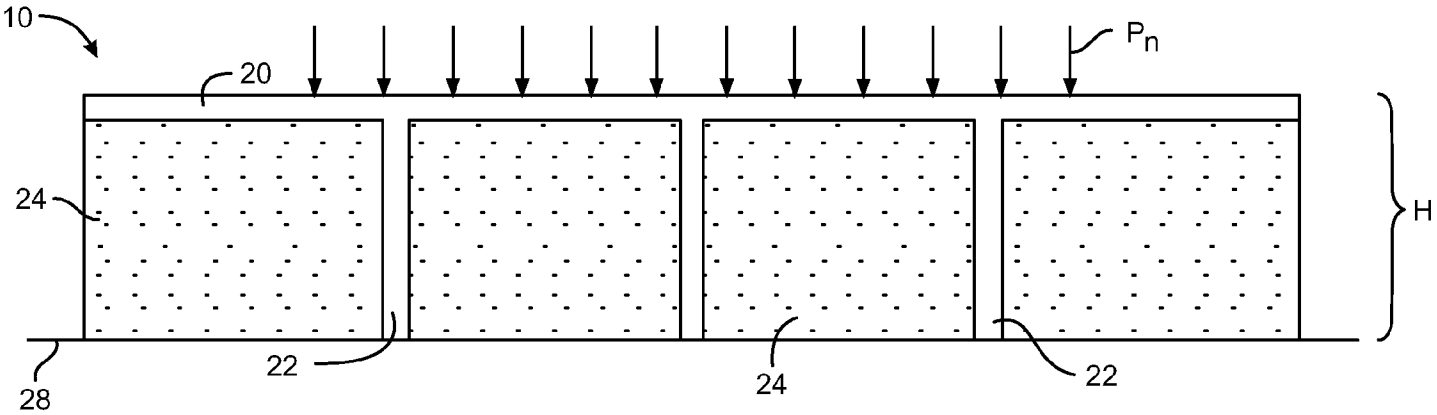
FIG. 3 is a side elevational view of the example flooring apparatus of FIG. 1 showing the floor being subjected to a compressive pressure under normal conditions.
Figure 4:
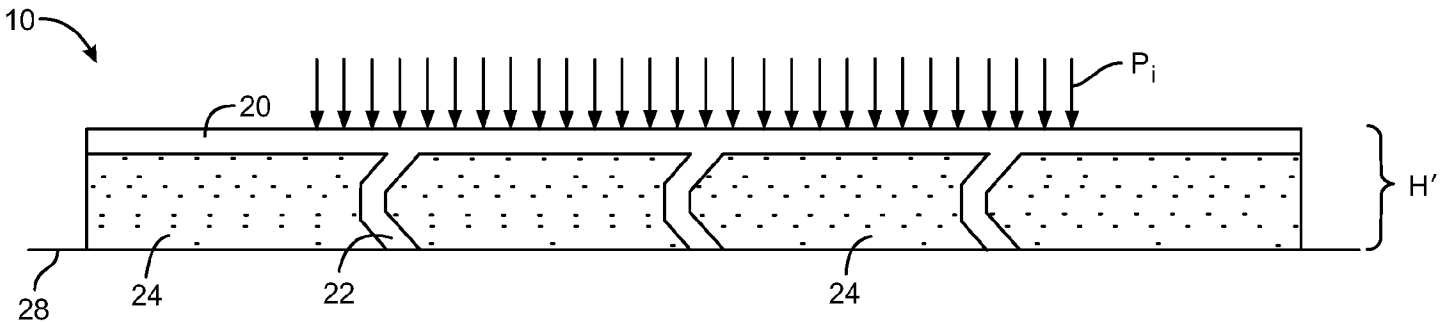
FIG. 4 is a side devotional view of the example flooring apparatus of FIG. 1 showing the floor being subjected to a compressive pressure under impact conditions.

Turning now to FIGS. 3 and 4, the flooring apparatus 10 is illustrated under the influence of two different compressive pressures. In FIG. 3, the flooring apparatus 10 is subjected to a compressive pressure $P_n$ distributed over the plate 20 under normal conditions, wherein the pressure $P_n$ is under a predetermined critical pressure (i.e., the pressure at which the column 22 will buckle). For example, the pressure $P_n$ may be the distributed pressure of an individual (or object) walking, standing, running, or otherwise moving over the plate 20. Under these conditions, the plate 20 of the apparatus 10 will not deflect in any appreciable manner, but rather the stiffening columns 22 will remain substantially rigid and will support the plate 20 at the normal height H above the support surface 28.

In FIG. 4, the flooring apparatus 10 is subjected to a compressive pressure $P_i$ distributed over the plate 20 under impact conditions, wherein the pressure $P_i$ is over the predetermined critical pressure (i.e., the pressure at which the column(s) 22 will buckle). For example, the pressure $P_i$ may be the distributed pressure of an individual falling on or otherwise impacting the plate 20. Additionally, while described as an impact pressure, the pressure Pi need not result from an impact, but rather may be any pressure, such as, for example, a static pressure. Under these conditions, a portion of the plate 20 of the apparatus 10 will deflect toward the support surface 28 (such as for example to a height H') and the stiffening columns 22 will buckle and deflect to absorb the energy of the impact. The columns 22 may, therefore, be the primary means of energy absorption, while the resilient nature of the underlayment 24 may provide a secondary means of energy absorption as the apparatus 10 deforms. After the impact pressure is removed, or otherwise dissipated, the apparatus 10 will substantially return to its original state and the plate 20 will once again be supported at the typical height H above the support surface 28 (FIG. 1).

Referring again to FIG. 2, the apparatus 10 of FIG. 1 is illustrated in a bottom side view, with a portion of the underlayment 24 removed to expose the plate 20. As illustrated, the columns 22 in this example have a generally rectangular cross-section, but it will be understood that the cross section may vary as desired. For example, because the stiffness of each of the columns 22 is directly proportional to the area moment of inertia of that column, in this example the stiffness of each column is generally greater in the y-direction than in the x-direction. Similarly, because the columns 22 are at least partially encapsulated in the underlayment 24, the properties of the underlayment 24 aid in the control of the buckling pressure, and the post-buckling deformation of the columns 22.

The critical pressure (e.g., the magnitude of the compressive pressure at which the column 22 will buckle) is determined by a number of factors, including, for example, the column length, width, area moment of inertia, material properties, the boundary conditions imposed at the column end points, the distribution of the columns on the plate 20, the angle at which the columns extend from the plate 20, and/or the properties of the underlayment 24. In one example, a desired predetermined critical pressure may be approximately 20 $lbs/in^2$. Because the critical pressure at which buckling of each of the columns 22 will occur is determined by many factors, it is possible to vary the design of the columns 22 and/or the underlayment 24 for a specifically desired critical pressure by varying some or all of these parameters utilizing known analysis methods such as Euler calculations and/or finite element analysis. Therefore it is possible to configure the columns 22 and/or the underlayment 24 so that the flooring apparatus 10 will remain relatively rigid under normal pressure but will buckle under impact pressures typically sustained during a fall. Varying the parameters of the columns 22 and/or the underlayment will permit construction of multiple embodiments having various uses from private dwellings, bathrooms, and geriatric homes to hospitals and athletic events where impact pressures are expectedly variable.

Figure 5:
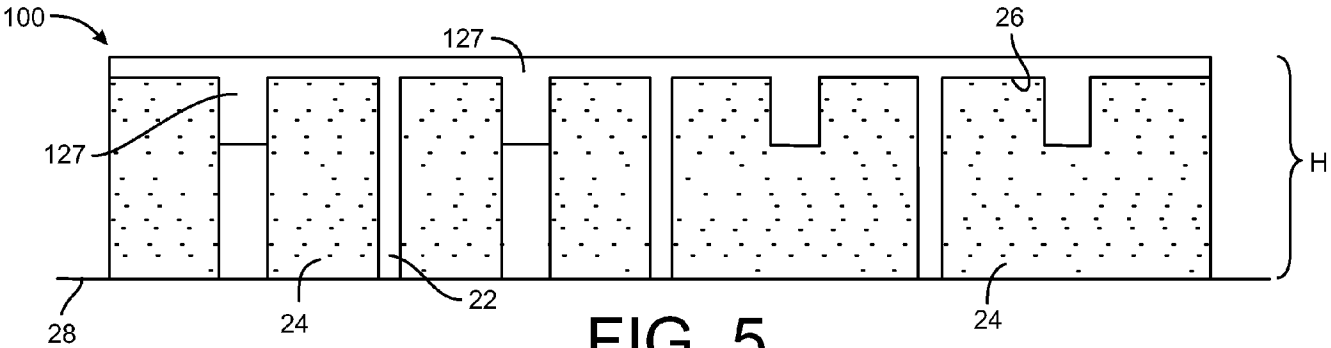
FIG. 5 is a side elevational view of another example flooring apparatus for reducing impact during a fall.
Figure 6:
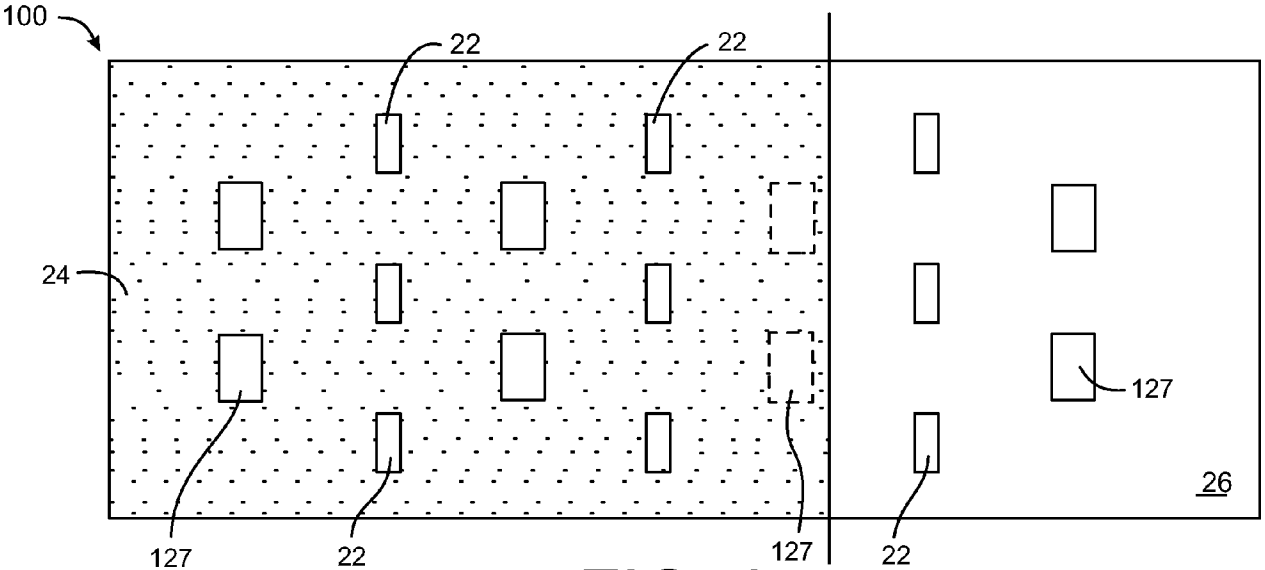
FIG. 6 is a bottom side view of the flooring apparatus of FIG. 5 with a portion of the underlayment removed.

FIGS. 5 and 6 illustrate another example of a flooring apparatus 100 similar to the flooring apparatus 10 of FIG. 1, but including a stop to prevent over-deformation. In particular, the apparatus 100 includes the flooring plate 20 having the plurality of spaced apart stiffening columns 22, extending from the undersurface 26 of the flooring plate 20 as described above. The apparatus 100, however, further includes a plurality of spaced apart deflection stops, such as stop columns 127, additionally extending from the undersurface 26 of the flooring plate 20. In this example, the stop columns 127 extend a shorter distance from the undersurface 26 of the plate 20 than the stiffening columns 22. As with the stiffening columns 22, each of the stop columns 127 may be integrally formed with the plate 20, or may be coupled to the plate 20 as desired.

In the illustrated example, both the stiffening columns 22 and the stop columns 127 extend generally perpendicular to the plate 20 and are, in this example, spaced at generally 45° to one another. However, it will be appreciated that the patient of the columns 22 and 127 may be varied as desired. Furthermore, while the length of each of the stiffening columns 22 and the length of each of the stop columns 127 are illustrated as being substantially similar, respectively, it will be understood that the length of each of the columns 22, 127 may vary as desired to provide for different pressure deflection characteristics.

As with the previous example, both the stiffening columns 22 and the stop columns 127 are at least partially surrounded by the resilient underlayment 24. Additionally, the underlayment 24 may be secured to at least a portion of the undersurface 26 of the flooring plate 20 and/or at least a portion of the columns 22, 127. As shown in FIG. 5, the resilient underlayment 24 may completely cover any of the columns 127 or may at least partially expose any of the columns 127 when viewed from the underside 26.

Figure 7:
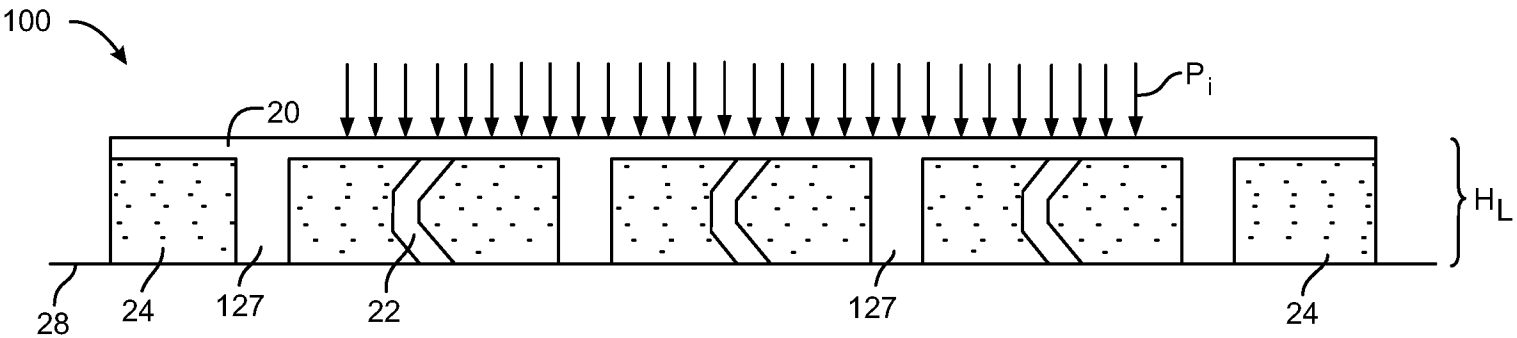
FIG. 7 is a side devotional view of the example flooring apparatus of FIG. 5 showing the floor being subjected to a compressive pressure under impact conditions.

FIG. 7 illustrates the example flooring apparatus 100 under the influence of a compressive pressure $P_i$ distributed over the plate 20 under impact conditions. As with the previous example, in this example, the pressure $P_i$ is greater than the predetermined critical pressure (e.g., the pressure at which the columns 22 will buckle). Under these conditions, the plate 20 of the apparatus 100 will deflect toward the support surface 28 and the stiffening columns 22 will deflect to absorb the energy of the impact. The amount of deflection in the plate 20, however, is limited at a height $H_1$ by contact of the deflection stop columns 127 with the support surface 28. The columns 22 may, therefore, be the primary means of energy absorption, while the resilient nature of the underlayment 24 provides a secondary means of energy absorption as the floor deforms. The stopping columns 127, meanwhile, may provide a deflection stop to prevent over-buckling and/or permanent deformation of the columns 22 as well as provide the ability for the flooring apparatus 10 to resume a substantially rigid state alter initial deflection to assist, for example, individuals utilizing wheelchairs. After the impact pressure is removed, or otherwise dissipated, the apparatus 10 will return substantially to its original state and the plate 20 will once again be supported at the typical height H above the support surface 28 (FIG. 5).

Figure 8:
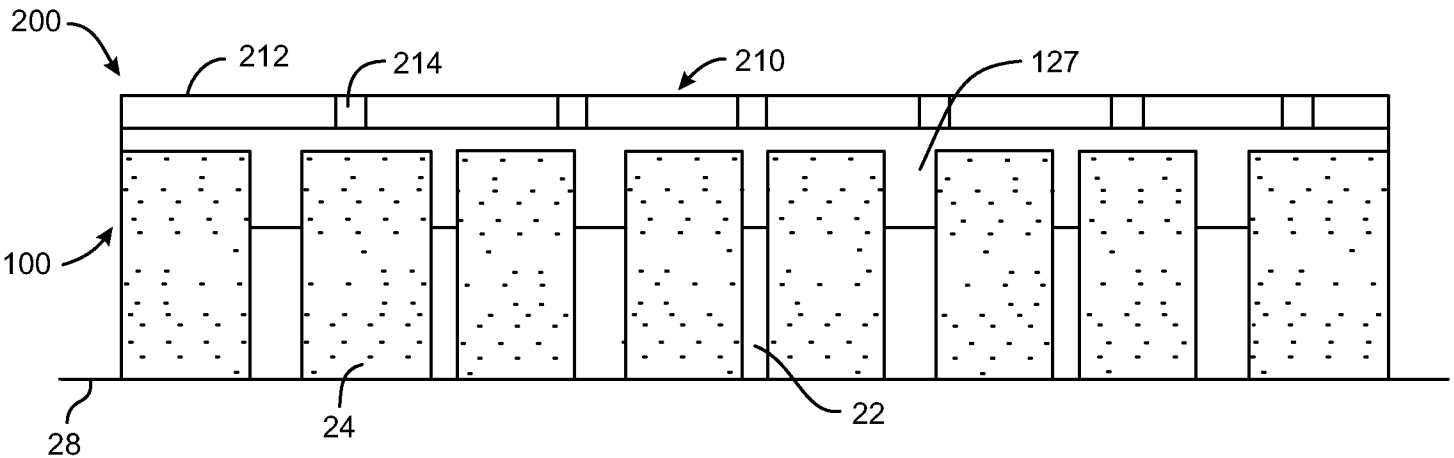
FIG. 8 is a side elevational view of the flooring apparatus of FIG. 5 including a tile overlayment.

Turning now to FIG. 8, an example of an enhanced flooring system 200 is shown. The system 200 includes one of the flooring apparatus 100 and/or 10 (the flooring apparatus 100 is illustrated) including an overlayment 210. In this example, the overlayment 210 comprises a plurality of tiles 212, such as traditional floor tiles, and a flexible grout 214, such as for example, a sand and silicon based grout. Accordingly, the tiles 212 and the grout 214 may deflect with the plate 20. The overlayment 210 may be any suitable flooring material, including, for example, carpeting, tiling, vinyl, etc. In this example, the tiles 212 width and length of each individual tile is less than the distance between each column 22.

Figure 9:
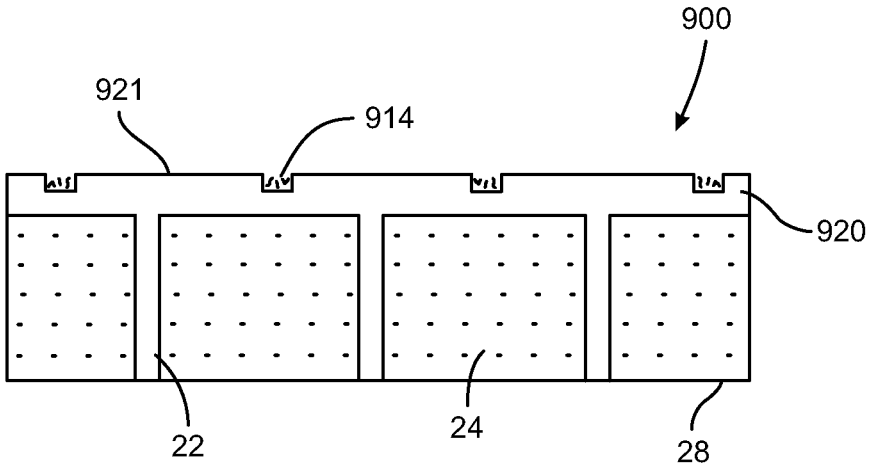
FIG. 9 is a side elevational view of an example flooring apparatus system including a channel.

In still another example, illustrated in FIG. 9, a flooring system 900 is shown. The example system 900 may be, for instance, a combination of the flooring apparatus 10 and the flooring system 200. In this example, the system 900 includes a flooring plate 920, which as disclosed may be a plate, membrane, tile, and/or any other suitable flooring surface and an overlayment 921. In one example, the overlayment 921 and the flooring plate 920 have similar mechanical properties, but it will be appreciated that the mechanical properties may vary as desired. In the disclosed example, the overlayment 921 is provided with a coating and/or other suitable treatment to allow the thickness of the overlayment 921 to be reduced as desired. In this example, the overlayment 921 and the plate 920 are rigidly bonded together, although the overlayment 921 and the plate 920 may be integrally formed, separately formed, detached, and/or otherwise rigidly and/or non-rigidly bonded. It will be further understood that the overlayment 921 may include any of a decorative design, pattern, material property, etc. Furthermore, the overlayment 921 may be provided with a wear and/or slip resistant material that may include various grip enhancing particle such as, for instance alumina, quartz, etc. It will be appreciated that in some instances, such as for example when the system 900 does not include an overlayment 921, the flooring plate 920 itself may include a decorative design, pattern, grip enhancing material, etc. For example, the plate 920 may include a decorative and/or functional feature, pattern, etc. The surface treatments may be formed with any suitable pattern forming technique including laser, dye sublimation, print methods, and/or any other suitable technique as desired.

In at least some instances, the overlayment 921 and/or the plate 920 may be formed of a particular material, such as for instance, a compliant wood material, such as for example cork, cork composites, bamboo, bamboo composites, yew, yew composites, wisteria, wisteria composites, woven wood textiles, any combination thereof, and/or any other suitable material. In one example, the portion of the surface of the overlayment 921 and/or the plate 920 that is exposed may be coated and/or otherwise impregnated with a wear and/or slip resistant material.

As illustrated in FIG. 9, the system 900, and more particularly the overlayment 921 and/or the plate 920 may include at least one channel 914, such as a channel, groove, trench, indentation, etc. In this example, the channel 914 may extend through the overlayment 921, thereby exposing the plate 920. The channel 914 may create a pattern such as a square, rectangle, triangle, hexagon, etc. As illustrated, the channel 914 may also be at least partially filled with a material such as a grout, sand, silicone, caulk, etc. The channel and/or material filter may give the contiguous floor 900 the appearance of a modular floor, such as a tile, etc.

In still other examples, any of the flooring systems 10, 100, 200, 900 may include materials specifically selected for properties such as noise abatement, water resistance, wear resistance, rot resistance, mildew and/or fungal resistance, durability, color, insulation (e.g., R-value), and/or any other desirable material characteristic. For instance, in one example, together the plate 20, the resilient underlayment 24 and the columns 22 may create a flooring system having a noise reduction coefficient of up to 1.0 and/or an insulation R-value of approximately 5 to 50. Additionally, in at least one example (not shown) the example flooring systems may include a radiant heating element including a radiant heating element for a modular bathroom system.

Figure 10:
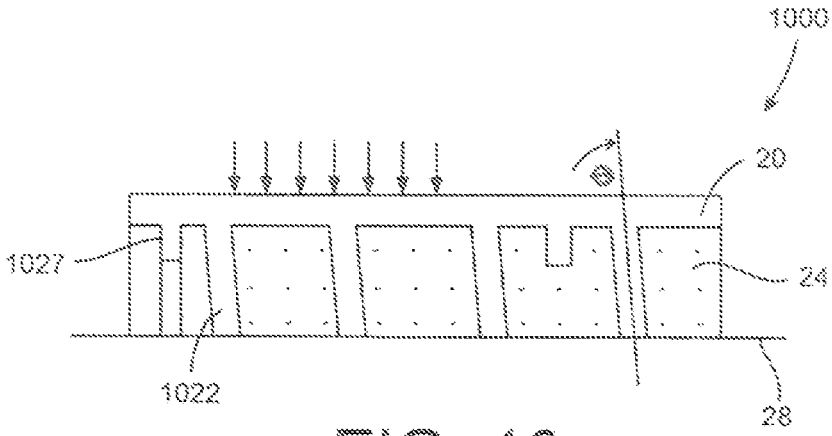
FIG. 10 is a side elevational view of an example flooring apparatus including a stiffening column having an angular offset.
Figure 11:
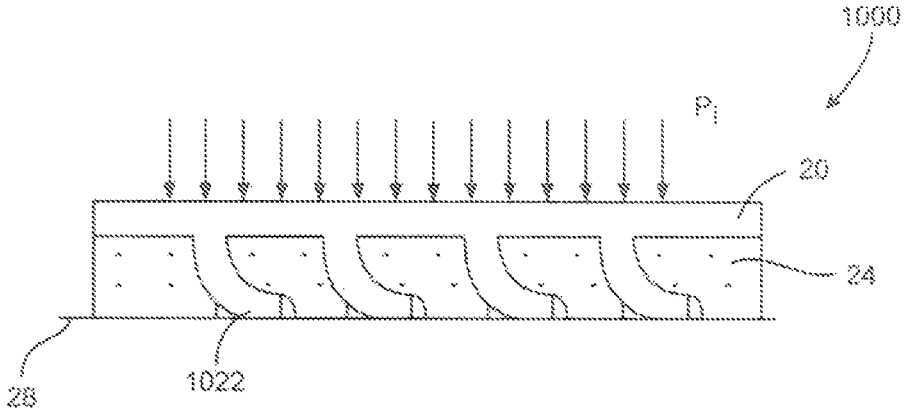
FIG. 11 is a side elevational view of the example flooring apparatus of FIG. 10 under impact conditions.

Turning now to FIGS. 10 and 11, another example flooring system 1000 is illustrated. In this example, a plurality of stiffening columns 1022 extend from the underside of the flooring plate 20. In this example, at least one of the stiffening columns 1022 include an angular offset from vertical θ, meaning the stiffening columns do not necessarily extend perpendicular from the flooring plate 20. In the illustrated example, the angular offset 0 is approximately from one to ten degrees. As with the stiffening columns 22, the stiffening columns 1022 remain substantially rigid up to a critical pressure (e.g., the pressure at which the column fails). In this instance, the critical pressure is determined by the coefficient of static friction between the support surface 28 and the column 1022. In particular, the columns 1022 remain substantially rigid up to the critical pressure and then bend and slide along the support surface 28 as the pressure $P_i$ increases. As seen in FIG. 10, the columns 1022 are at least partially surrounded by the resilient underlayment 24. Additionally, as will be appreciated, the resilient underlayment may be at least partially bonded to the column 1022 as desired.

As illustrated in FIG. 11, the columns 1022 will fail after the critical pressure by buckling, bending, folding, and/or sliding. As will be appreciated, the width of the column and the compressed width of the resilient underlayment after compression may assist in providing a substantially rigid floor at very high pressures to stop deflection of the floor plate 20 towards the support surface 28. In the example (as shown in FIG. 10) the floor 1000 may include at least one deflection stop 1027 to assist in preventing over deflection of the flooring plate 20 towards the support surface 28.

Figure 12:
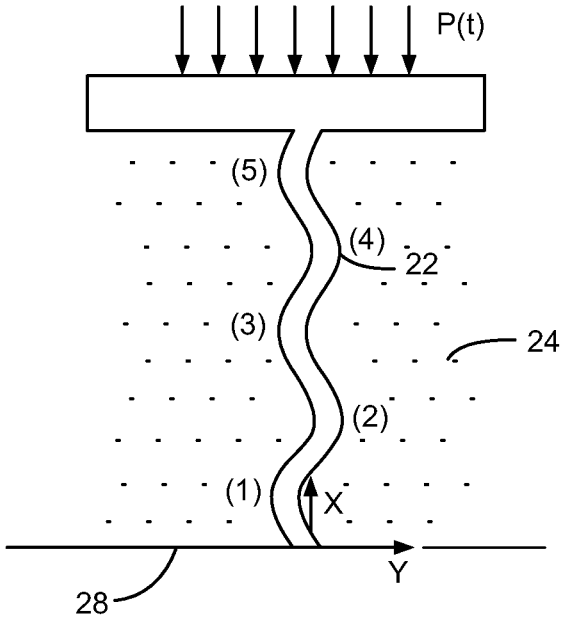
FIG. 12 is a side elevational view of an example flooring apparatus including a stiffening column having a complex geometry.

Turning now to FIG. 12, another example method of failure of the stiffening column 22 is illustrated. In this example, the stiffening column 22 still fails by buckling, but rather than failing by static buckling as illustrated in the previous examples, the illustrated stiffening column fails by dynamic buckling. Specifically, in this example, the column 22 fails along a dynamic buckling wave comprising five half sine waves labeled (1) to (5). In this instance the number of half sine waves is dictated by the mechanical and geometrical properties of the column 22 and the magnitude and time-dependent nature of the pressure in the floor $P_{(i)}$. The critical column buckling pressure, under dynamic buckling conditions, such as when the load P(t) is applied very suddenly and then removed, can greatly exceed the critical column buckling pressure under static conditions.

In yet another example, any of the disclosed the flooring systems 10, 100, 200, 900, may include an alarm and/or other sensor to detect a particular pressure, such as for example, when something and/or someone falls on the flooring system. In one example, the flooring system includes a small proximity sensor, such as a radio frequency (RF) sensor placed in the cavity between the support surface 28 and the underside of the flooring plate 20. The proximity sensor may be arranged in a regular pattern, such as, for instance a regular grid pattern. In this example, the sensors are powered by a nearby wireless transmitter, but it will be understood by one of ordinary skill in the art that the sensors may be powered by any suitable power source. In at least one example, the sensors may be calibrated to detect and/or otherwise sense a mass a certain distance (e.g., one foot) above the flooring plate 20. Thus, when an object such as a person is above the sensor network, the maximum output from the network is proportional to sensing the mass of two feet and two legs below the knees, which could be considered a relatively low output level. If a person were to lay down above the sensor, the mass of the entire body would be detected, which would be considered a relatively high output level. Thus, in a high output level (e.g., a person has fallen) the sensors could detect the condition and issue an alarm as it would be likely that a person had fallen on the flooring system and may require assistance.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

I claim:

1. An apparatus comprising:

an impact surface;

a plurality of spaced apart incompressible stiffening columns extending between one side of the impact surface and a support surface, and supporting the impact surface a distance above the support surface, wherein when the apparatus is subjected to a compressive pressure between the impact surface and the support surface less than a critical pressure defined as the pressure at which the stiffening columns will buckle, the stiffening columns remain incompressible so as to substantially prevent movement of the impact surface towards the support surface, and when the apparatus is subjected to a compressive pressure between the impact surface and the support surface greater than the critical pressure, at least one of the stiffening columns deform by buckling, thereby allowing deflection of the impact surface towards the support surface, changing the distance between the flooring plate and the support surface;

a resilient underlayment at least partially surrounding at least a portion of the plurality of spaced apart stiffening columns and substantially filling a space between the plurality of stiffening columns, the resilient underlayment coupled to the stiffening columns at at least one location to influence the post-buckling deformation of the stiffening column, and to substantially prevent permanent deformation of the stiffening column.

2. An apparatus as defined in claim 1, further comprising an overlayment at least partially covering the impact surface.

3. An apparatus as defined in claim 2, wherein the overlayment is bonded to the impact surface.

4. An apparatus as defined in claim 3, wherein the overlayment is rigidly bonded to the impact surface.

5. An apparatus as defined in claim 2, wherein an exposed surface of at least one of the impact surface and the overlayment includes at least one of a wear or slip resistant material.

6. An apparatus as defined in claim 2, wherein the overlayment comprises at least one of a cork, bamboo, yew, wisteria, a woven wood textile material, or a composite thereof.

7. An apparatus as defined in claim 1, wherein an exposed surface of the impact surface includes at least one of a wear or slip resistant material.

8. An apparatus as defined in claim 1, wherein the impact surface includes a channel.

9. An apparatus as defined in claim 1, wherein the apparatus has a noise reduction coefficient of up to 1.0.

10. An apparatus as defined in claim 1, wherein the apparatus has an R-value of approximately 5 to 50.

11. An apparatus as defined in claim 1, wherein at least one of the stiffening columns extends from the impact surface an offset angle from perpendicular.

12. An apparatus as defined in claim 11, wherein the offset angle is approximately from one to ten degrees.

13. An apparatus as defined in claim 11, further comprising a plurality of spaced apart substantially incompressible deflection stop columns, extending from the underside of the flooring plate toward the support surface, wherein when the apparatus is subjected to a compressive pressure less than the critical pressure, the stop columns do not contact the support surface, and when the floor is subjected to a compressive pressure greater than the critical pressure the stop columns contact the support surface to substantially prevent the flooring plate from further movement toward the support surface.

14. An apparatus as defined in claim 11, wherein the deformation by buckling further comprises the stiffening column sliding against the support surface.

15. An apparatus as defined in claim 11, wherein the deformation by buckling further comprises the stiffening column bending.

16. An apparatus as defined in claim 1, wherein the apparatus is a flooring system.

17. An apparatus as defined in claim 1, wherein at least a portion of the impact surface includes a pattern.

18. An apparatus as defined in claim 17, wherein the pattern is formed by at least one of laser, dye sublimation, or other print method.

19. An apparatus comprising:

an impact surface;

a plurality of spaced apart incompressible stiffening columns extending between one side of the impact surface and a support surface, and supporting the impact surface a distance above the support surface, wherein when the apparatus is subjected to a compressive pressure between the impact surface and the support surface less than a critical pressure defined as the pressure at which the stiffening columns will buckle, the stiffening columns remain incompressible so as to substantially prevent movement of the impact surface towards the support surface, and when the apparatus is subjected to a compressive pressure between the impact surface and the support surface greater than the critical pressure, at least one of the stiffening columns deform by buckling, thereby allowing deflection of the impact surface towards the support surface, changing the distance between the flooring plate and the support surface;

a resilient underlayment at least partially surrounding at least a portion of the plurality of spaced apart stiffening columns and substantially filling a space between the plurality of stiffening columns, the resilient underlayment coupled to the stiffening columns at at least one location to influence the post-buckling deformation of the stiffening column, and to substantially prevent permanent deformation of the stiffening column, wherein at least one of the stiffening columns extends from the impact surface an offset angle from perpendicular, and wherein the deformation by buckling is dynamic buckling.

* * * * *